US007036828B1

(12) United States Patent
Loveridge

(10) Patent No.: US 7,036,828 B1
(45) Date of Patent: May 2, 2006

(54) EXTRUDED LIGHT-WEIGHT FIGURE SKATE BLADE HOLDER WITH TWO PART BLADE

(75) Inventor: Malvin Loveridge, Kitchener (CA)

(73) Assignee: Tournament Sports Marketing Inc., Waterloo (CA)

( * ) Notice: Subject to any disclaimer, the term of this patent is extended or adjusted under 35 U.S.C. 154(b) by 0 days.

(21) Appl. No.: 10/964,781

(22) Filed: Oct. 15, 2004

(51) Int. Cl.
*C03C 27/02* (2006.01)

(52) U.S. Cl. ..... 280/11.18; 280/11.12

(58) Field of Classification Search ..... 280/11.18, 280/11.17, 11.19, 819, 602, 11.12
See application file for complete search history.

(56) References Cited

U.S. PATENT DOCUMENTS 3,947,050 A * 3/1976 Isely ..... 280/11.18
6,086,084 A * 7/2000 Wemmenhove ..... 280/602
6,301,771 B1 * 10/2001 Benoit ..... 29/557
6,318,738 B1 * 11/2001 Abkowitz et al. ..... 280/11.18
6,409,183 B1 * 6/2002 Wemmenhove ..... 280/11.18
6,467,778 B1 * 10/2002 Goldsmith et al. ..... 280/11.12
6,485,033 B1 * 11/2002 Nicoletti et al. ..... 280/11.18
6,523,835 B1 * 2/2003 Lyden ..... 280/11.12
6,830,251 B1 * 12/2004 Titzmann ..... 280/11.18
6,848,694 B1 * 2/2005 Benoit ..... 280/11.221
2001/0040351 A1 * 11/2001 Cheatham et al. ..... 280/11.231
2003/0011150 A1 * 1/2003 Goldsmith et al. ..... 280/11.18
2003/0234499 A1 * 12/2003 Rudolph ..... 280/11.17

* cited by examiner

*Primary Examiner*—J. Allen Shriver
(74) *Attorney, Agent, or Firm*—Miller Thomson LLP

(57) ABSTRACT

An extruded light-weight blade support with a blade for a figure skate including an extruded holding means having a first portion and a second portion and a blade removably mounted to the extruded holding means. The first and second portions may be mounted to the figure skate. The extruded holding means may be made from aluminium and the blade may be made from a light-weight alloy such as titanium or magnesium. A strip of carbon steel may be adhered to a bottom edge of the blade.

16 Claims, 7 Drawing Sheets

EXTRUDED LIGHT-WEIGHT FIGURE SKATE BLADE HOLDER WITH TWO PART BLADE

FIELD OF THE INVENTION

This invention relates in general to a support for a figure skate blade and more particularly to an extruded light-weight figure skate blade holder that is mounted to a figure skate boot and holds a two-part figure skate blade.

BACKGROUND OF THE INVENTION

The skating industry includes a number of very different skating sports, such as hockey, figure skating, and speed skating. The concepts found in the skating industry can also be used in the roller blade industry. The popularity of these sports both at the recreational level and professional level has increased dramatically around the world resulting in changes to skate boots, blades and blade holder systems which strive to improve both the performance and the comfort of the boot, blade and bald holder.

For example, Shum is the owner of U.S. Pat. No. 6,105,975 issued on Aug. 22, 2000, which relates to a lightweight ice skate for reducing and eliminating the vibrations experienced by a skater. The skate includes a skate blade, a plurality of bumpers and a pair of metal support mounts to which a skate boot is secured. The support mounts include blade receiving portions in which the skate blade is secured. The skate blade is formed of a high grade steel, preferably stainless steel. Stainless steel blades hold their edges longer, cut into the ice better and will not rust over time. The support mounts are formed of a lightweight, stiff, rigid metal such as aircraft grade aluminium. Other materials that can be used to form the support mounts include metal matrix composites and carbon fiber/KEVLAR composites.

Hill et al. is the owner of U.S. Pat. No. 5,505,467 which issued on Apr. 9, 1996. This patent relates to a skate support and bracket system includes an elongated main body structure in the form of a tubular aluminium extrusion. A bracket attachment track is formed on the extrusion. A pair of boot brackets is slidably mounted on the track for continuous and infinitesimal movement there along. The brackets carry boot mounting platforms at the upper ends thereof and the platforms are cantilevered outwardly from the upper end of the pedestal both rearwardly and laterally so as to present a generally unimpeded area under the platform to facilitate manipulation of an attachment component. Main support body structure 24 may preferably be formed as a tubular aluminium extrusion. Thus, the overall weight of the system may conveniently be reduced.

Myers et al. is the owner of U.S. Pat. No. 5,735,536 which issued on Apr. 7, 1998, and relates to a skate assembly has a skate chassis, a boot and a motive member such as rollers or an ice blade. The skate chassis having an elongated body, a heel member and a toe member. The body having concave portions which reduce torsional flex on the chassis. Raised ribs and channels of the body and the members are engaged so as to allow the members to slide longitudinally along the body. The boot can be mounted on the heel and the toe members, and the motive member can be attached to the chassis, thus forming a skate assembly. The toe member having a curving plate for preserving the shape of the boot. Moreover, the heel and toe members can be positioned at numerous distances from one another on the body, thus supporting different boot sizes and providing different positions for the boot on the body.

Although the prior art discloses various support assemblies for different types of skates with various blades, none of the prior art addresses an improved light-weight blade support that has a two-part blade for a figure skate. Thus an extruded light-blade holder for a figure skate that has a two part blade and is significantly lighter, has reduced maintenance with increased longevity and improved performance during the execution of figure skate elements is desirable.

SUMMARY OF THE INVENTION

An object of one aspect of the present invention is to provide an improved extruded light-weight blade support for a figure skate with a two part blade.

In accordance with one aspect of the present invention there is provided an extruded light-weight blade support with a blade for a figure skate including an extruded holding means having a first portion and a second portion and a blade removably mounted to the extruded holding means. The first and second portions may be mounted to the figure skate.

Conveniently, the extruded holding means may be an extruded one piece blade holder and the first portion is a toe plate and the second portion is a heel plate. Both the toe plate and the heel plate may be integrated into the extruded one piece blade holder.

Preferably, the extruded one piece blade holder may be made from aluminium and the blade may be made from a light-weight alloy such as titanium or magnesium. A strip of carbon steel may be adhered to a bottom edge of the blade.

Advantages of the present invention are light yet strong versatile figure skating blade, two-part blade holder and blade, carbon steel strip allows for sharpening and sharp edge retention, blade does not require plating chrome or nickel plating, reduces chipping and peeling issues as a result of wear on the blade, over all reduction of maintenance and service to entire figure skate, blade holder is one piece extruded from aluminium, blade holder is light yet strong, blade holder does not have any joints where the toe and heel plate are located, blade is removable allowing the exchange of blades due to excessive wear or preference in blades rather than having to replace the complete skate, light weight design improves figure skaters technique and performance thereby reducing the number of injuries specifically continual vertical, horizontal and circular impact.

BRIEF DESCRIPTION OF THE DRAWINGS

A detailed description of the preferred embodiments are provided herein below by way of example only and with reference to the following drawings, in which.

Figure 1:
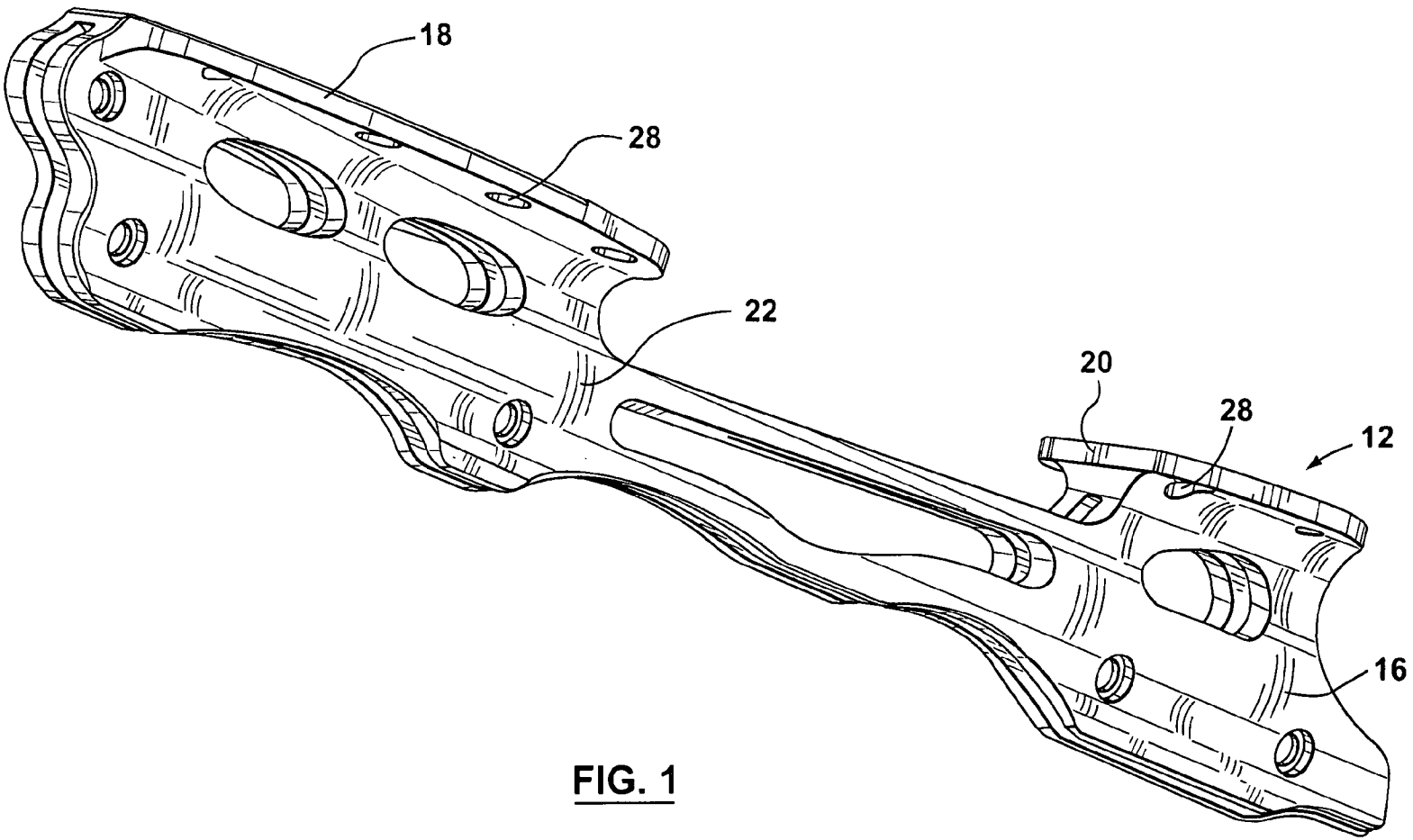
FIG. 1 in a perspective view, illustrates an extruded light-weight figure skate blade holder in accordance with a preferred embodiment of the present invention.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT

Figure 4:
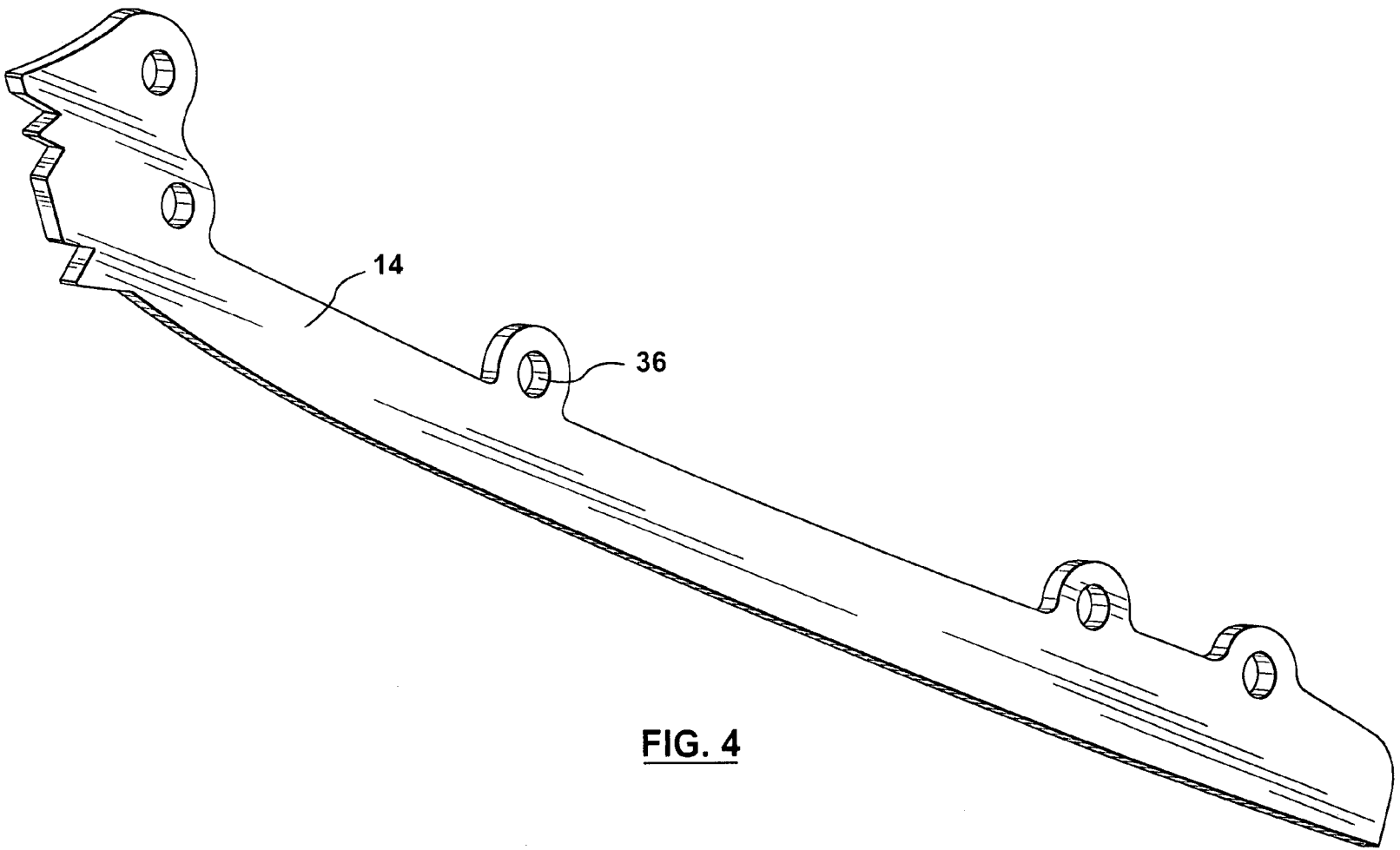
FIG. 4 in a perspective view, illustrates a two part figure skate blade in accordance with a preferred embodiment of the present invention.
Figure 8:
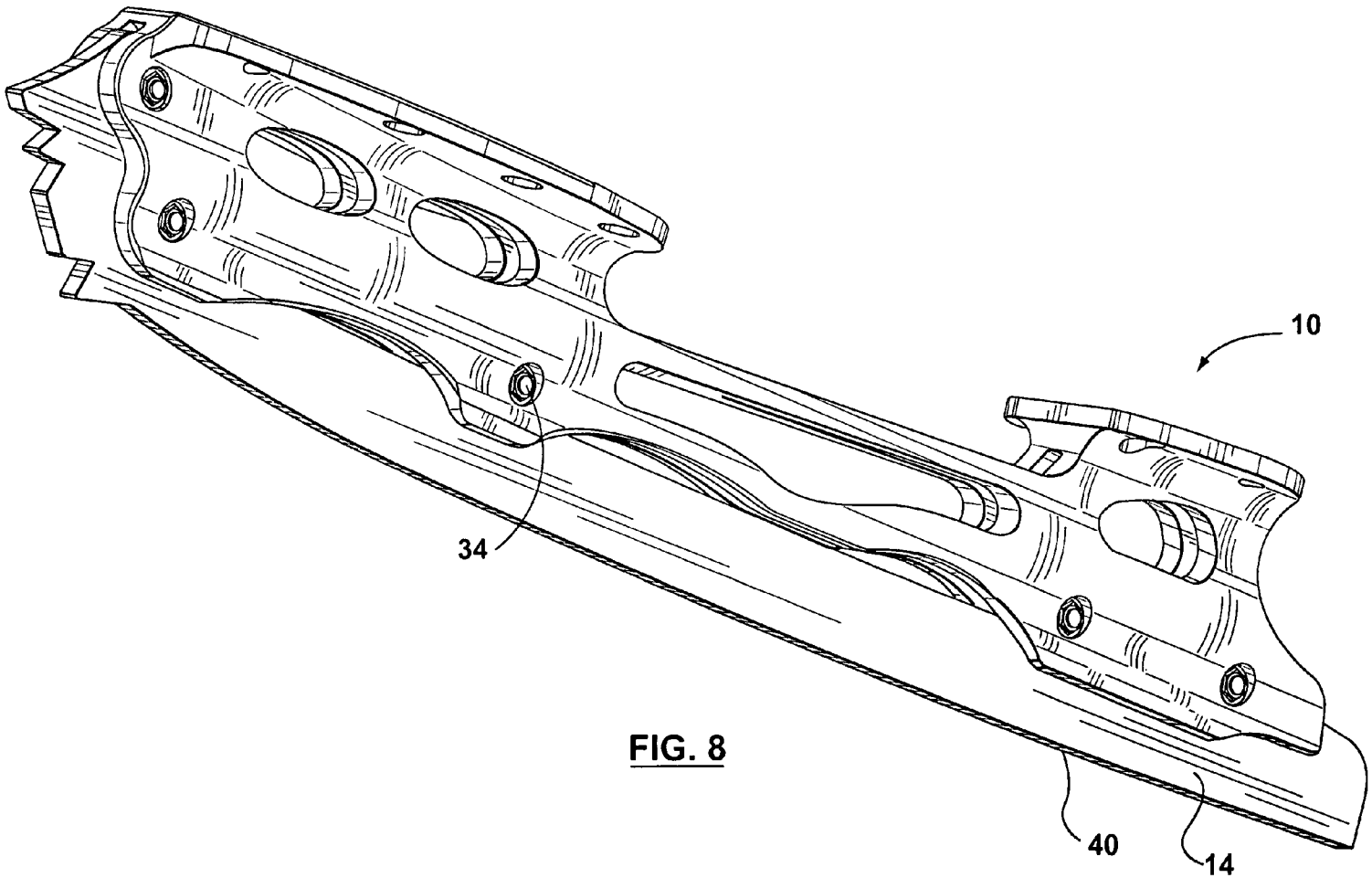
FIG. 8 in a perspective view, illustrates the extruded light-weight figure skate blade holder and the two part figure skate blade in accordance with a preferred embodiment of the present invention.

Referring to FIGS. 1, 4, and 8 there is illustrated in perspective views, an extruded light-weight blade support 12 with a blade 14 for a figure skate in accordance with a preferred embodiment of the present invention. The extruded light-weight blade support 12 with a blade 14 for a figure skate includes an extruded holding means 16 having a first portion 18 and a second portion 20 and a blade 12 removably mounted to the extruded holding means 16. The first and second portions 18 and 20 may be mounted to the figure skate. The extruded holding means 16 may be further defined is an extruded one piece blade holder 22.

Figure 2:
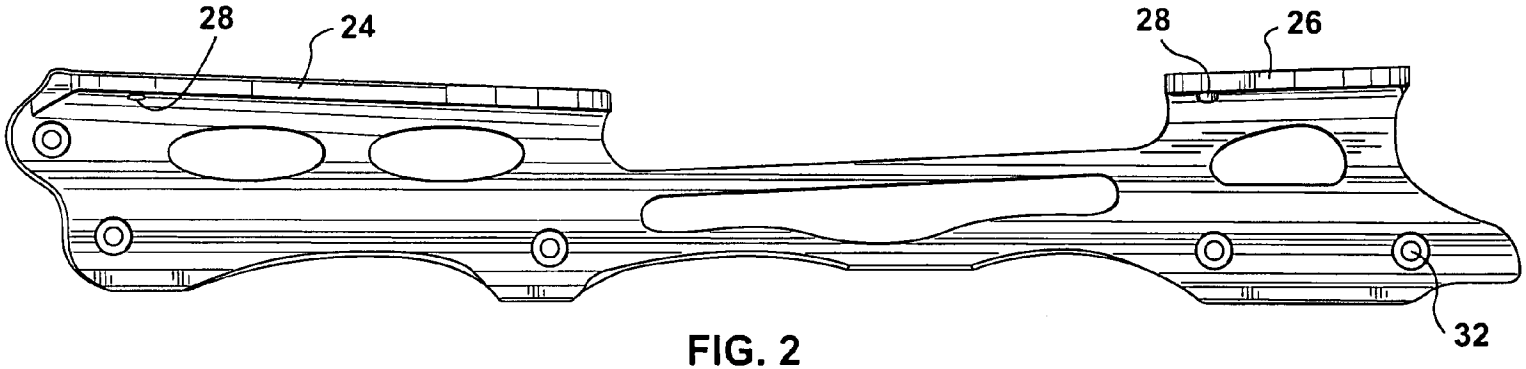
FIG. 2 in a side view, illustrates the extruded light-weight figure skate blade holder of FIG. 1.
Figure 3:
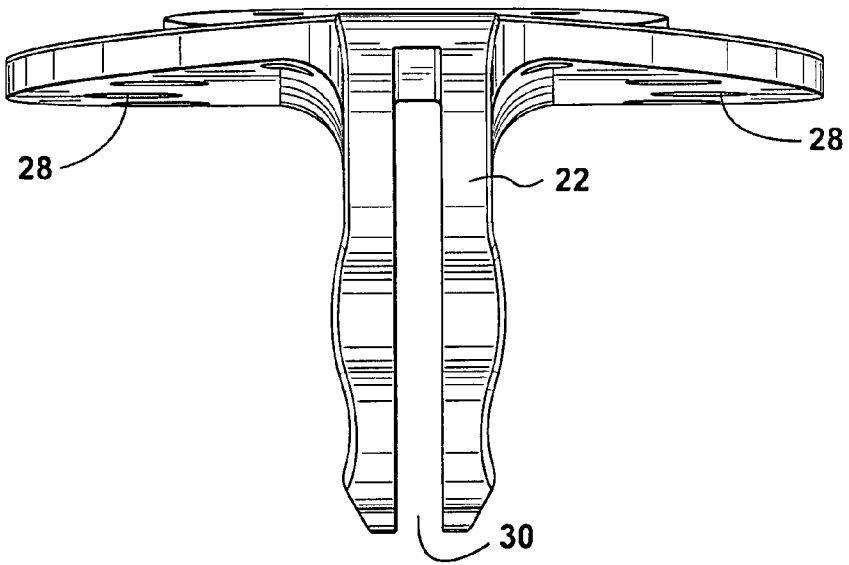
FIG. 3 in an end view, illustrates the extruded light-weight figure skate blade holder of FIG. 1.

Referring to FIGS. 2 and 3 the first portion 18 may be further defined as a toe plate 24 and the second portion 20 may be further defined as a heel plate 26. Both the toe plate 24 and the heel plate 26 are integrated into the extruded one piece blade holder 22. The extruded one piece blade holder 22 may be made from aluminium and more specifically aircraft aluminium such as #6061 aircraft aluminium. The use of aluminium allows the one piece blade holder 22 to be extruded as well as being very strong yet very light at the same time. Furthermore the ability to produce a one piece blade holder 22 eliminates all types of assembly constraints since there is only one piece to the holder. Finally the reduction to the over all weight of the light weight blade support by using aluminium allows different types of metals to be used as runners.

Traditionally a skate chassis comes in two pieces, in other words the toe plate and the heel plate are separate and are attached to the bottom of a skate boot. The blade or runner is then mounted, usually through braising to the toe and heel plates, therefore making a total of three parts. In the current invention the integration of the toe plate 24 and the heel plate 26 into the extruded one piece blade holder 22 means the there are no joints between the toe and heel plates, 24 and 26, and the one piece blade holder 22.

Both of the toe plate 24 and the heel plate 26 have apertures 28 that are adapted to receive a fastening means (not shown) that mount the toe plate 24 and the heel plate 26 to the bottom of the figure skate boot. Referring to FIG. 3 the extruded one piece blade holder 22 may further include a slot 30 adapted to receive the removeably mounted blade 14.

Figure 5:
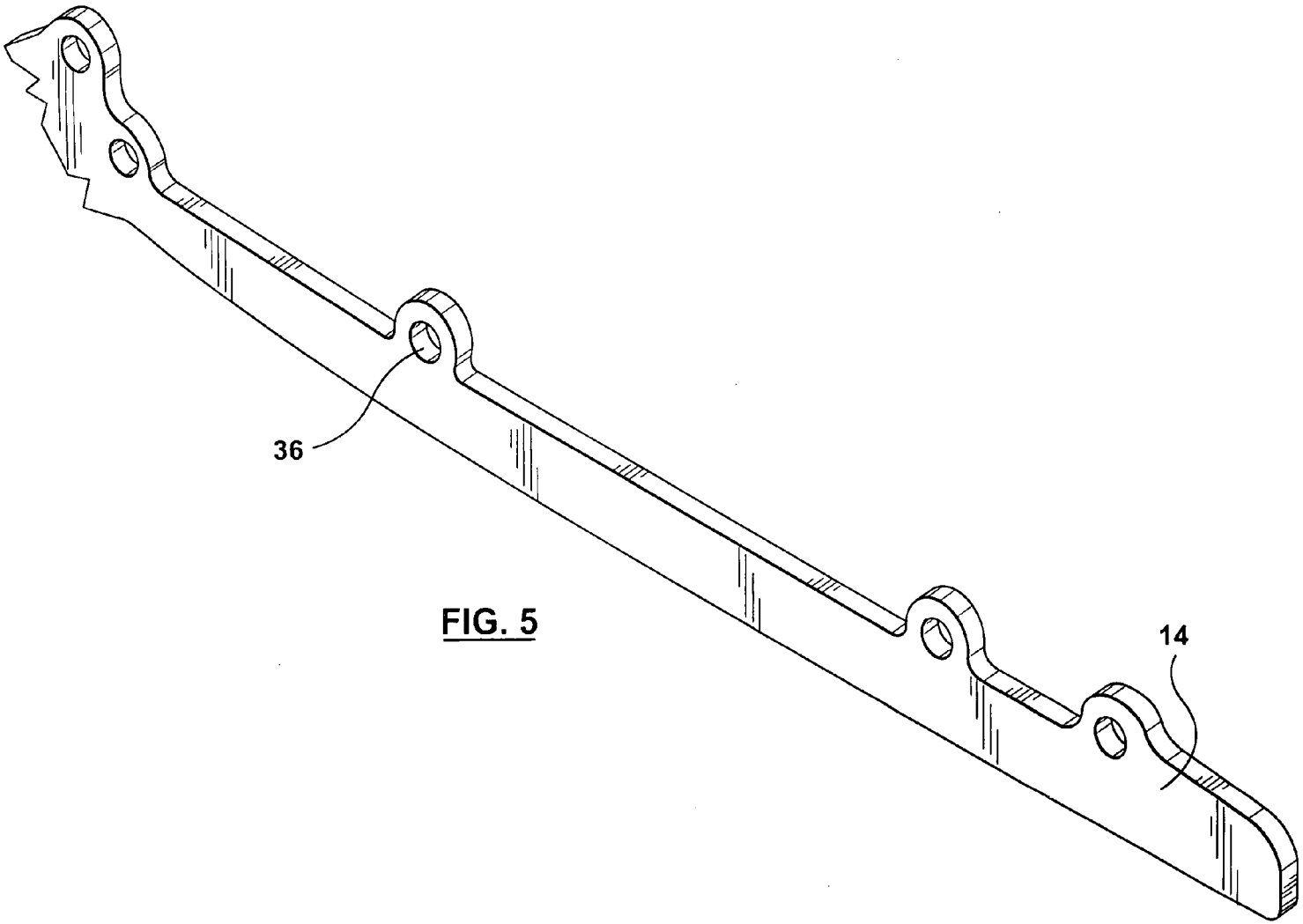
FIG. 5 in a perspective view, illustrates the two part figure skate blade of FIG. 4.
Figure 6:
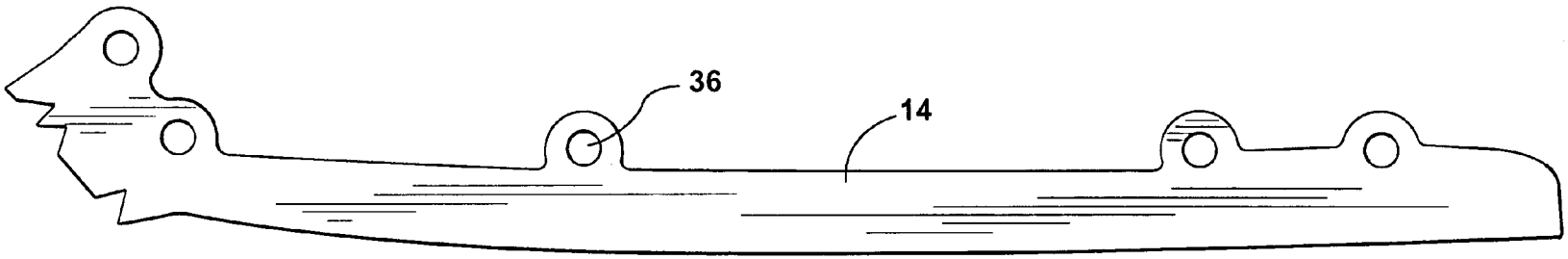
FIG. 6 in a side view, illustrates the two part figure skate blade of FIG. 4.
Figure 7:
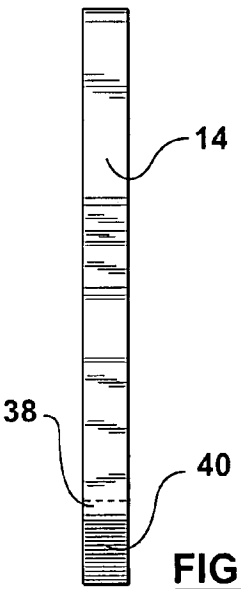
FIG. 7 in an end view, illustrates the two part figure skate blade of FIG. 4.

Referring to FIGS. 2 and 8, the one piece blade holder 22 may further include a series of apertures 32 that are adapted to receive a fastening means 34 for securing the blade 14 in the slot 30 of the extruded one piece blade holder 22. Referring to FIGS. 4, 5, and 6 the blade 14 may further include a series of apertures 36 adapted to receive the fastening means 34 for mounting the blade 14 to the extruded one piece blade holder 22. The fastening means 34 may be further defined as removable bolts and nuts. By bolting the blade 14 into position, the blade 14 may be easily removed at any time. A removable blade 14 allows for the skater to easily exchange blades 12 if there is excessive wear or for a different design of blade. With conventional figure skates there is no ability to exchange blades and whole new figure skates are required at considerable added expense.

Referring to FIGS. 4, 5, 6 and 7, the blade 14 may be made or configured from different metals as a result of using an extruded one piece blade holder 22 which is made out of aluminium. The blade 14 may be made from a light-weight alloy such as titanium or magnesium by way of example only. The blade 14 therefore is very lightweight and strong. However as a skate blade has to have a sharp edge which must be maintained for figure skating, the use of titanium or magnesium for the sharp edge is not appropriate as these types of light-weight alloys do not hold this sharp edge as they are too soft. The most acceptable metal is carbon steel as it can be sharpened to the appropriate sharp edge and this sharp edge can also be maintained for high level figure skating.

Figure 9:
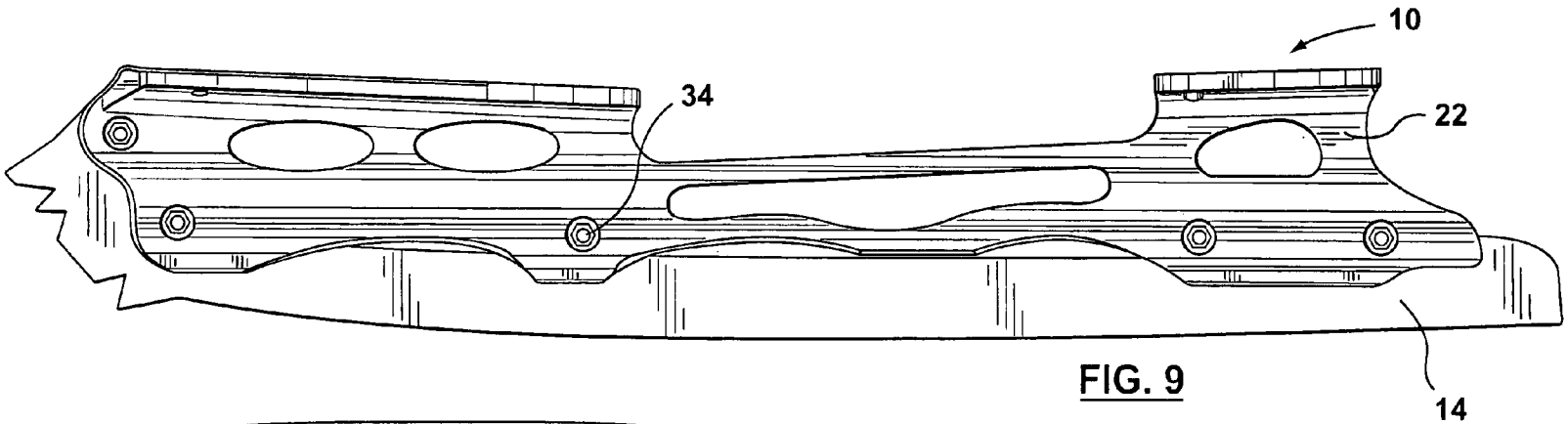
FIG. 9 in a side view, illustrates the extruded light-weight figure skate blade holder and the two part figure skate blade of FIG. 8.
Figure 10:
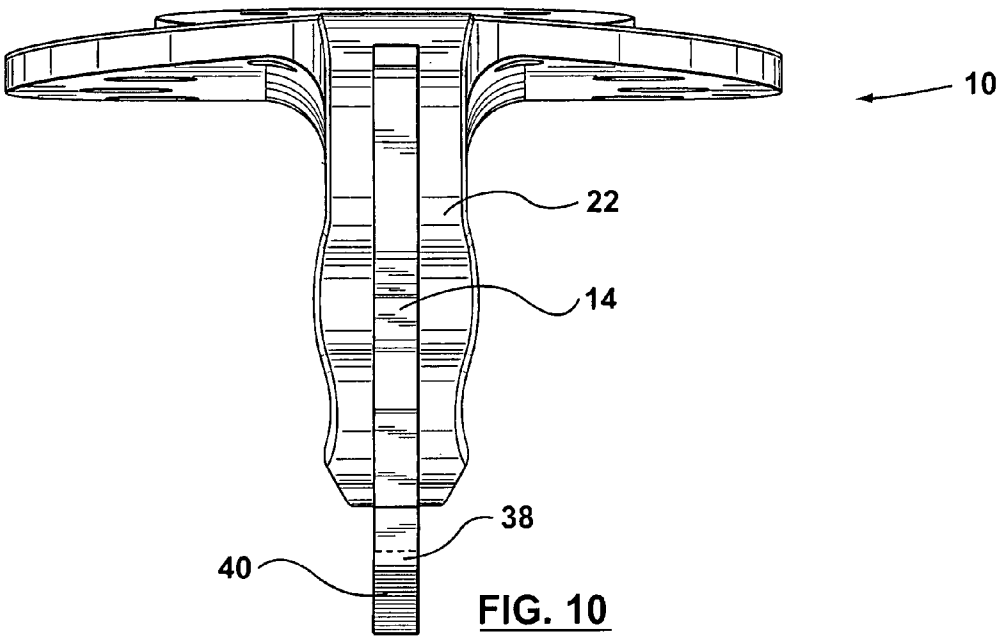
FIG. 10 in an end view, illustrates the extruded light-weight figure skate blade holder and the two part figure skate blade of FIG. 8.

Referring to FIGS. 9 and 10, as such the blade 14 disclosed in the present invention is a two part blade 14. The majority of the blade 14 may made out of a light-weight alloy such as titanium or magnesium and may further include a bottom edge 38 to which a strip of hard material such as carbon steel 40 is adhered. More specifically the strip of carbon steel may be one eighth wide located on the bottom of the edge 38.

The two part blade 14 may be produced by mechanically fastening the strip of hard material 40 to the light weight alloy of the blade 14. The seams caused by the joining of the light-weight alloy and the strip of hard material 40 are then chemically adhered together to form a single combined blade 14. The blade 14 may then be laser cut and processed to a desired finish quality, therefore resulting in a blade 14 that is light but has the capability of holding its sharpened edge. Furthermore the blade 14 does not require braising or welding and does not require chrome or nickel plating which can peel or chip through wear. Finally the weight of the blade and the skate support are not limited in any way as light-weight materials can be used for both the blade and the skate support. The overall weight reduction of the figure skate has an immediate effect on improving the skater's technique and performance and will therefore reduce physical stress on the skater's body as well as aid in injury reduction.

Other variations and modifications of the invention are possible. All such modifications or variations are believed to be within the sphere and scope of the invention as defined by the claims appended hereto.

I claim:

1. An extruded light-weight blade support with a blade for a figure skate comprising:

(a) an aluminum extruded one piece blade holder having a first portion toe plate integrated to a second portion heel plate; and (b) a titanium blade having a bottom edge with a strip of carbon steel adhered to said bottom edge, said titanium blade removably mounted to said aluminum extruded one piece blade holder, wherein said first and second portion are mounted to said figure skate.

2. An extruded light-weight blade support with a blade for a figure skate as claimed in claim 1 wherein said toe plate and said heel plate have apertures adapted to receive a fastening means to mount said toe plate and said heel plate to said figure skate.

3. An extruded light-weight blade support with a blade for a figure skate as claimed in claim 2 wherein said extruded one piece blade holder further comprises a slot adapted to receive said removeably mounted blade.

4. An extruded light-weight blade support with a blade for a figure skate as claimed in claim 3 wherein said one piece blade holder further comprises a series of apertures adapted to receive a fastening means for securing said blade in said slot of said extruded one piece blade holder.

5. An extruded light-weight blade support with a blade for a figure skate as claimed in claim 4 wherein said fastening means are removable bolts and nuts.

6. An extruded light-weight blade support with a blade for a figure skate as claimed in claim 1 wherein said strip of carbon steel is chemically adhered to said light-weight alloy of said bottom edge.

7. An extruded light-weight blade support with a blade for a figure skate as claimed in claim 6 wherein said strip of carbon steel is one eighth of an inch wide.

8. An extruded light-weight blade support with a blade for a figure skate as claimed in claim 1 wherein said blade is laser cut.

9. An extruded light-weight blade support with a blade for a figure skate comprising:

(a) an aluminum extruded one piece blade holder having a first portion toe plate integrated to a second portion heel plate; and (b) a magnesium blade having a bottom edge with a strip of carbon steel adhered to said bottom edge, said titanium blade removably mounted to said aluminium extruded one piece blade holder, wherein said first and second portion are mounted to said figure skate.

10. An extruded light-weight blade support with a blade for a figure skate as claimed in claim 9 wherein said toe plate and said heel plate have apertures adapted to receive a fastening means to mount said toe plate and said heel place to said figure skate.

11. An extruded light-weight blade support with a blade for a figure skate as claimed in claim 10 wherein said extruded one piece blade holder further comprises a slot adapted to receive said removeably mounted blade.

12. An extruded light-weight blade support with a blade for a figure skate as claimed in claim 11 wherein said one piece blade holder further comprises a series of apertures adapted to receive a fastening means for securing said blade in said slot of said extruded one piece blade holder.

13. An extruded light-weight blade support with a blade for a figure skate as claimed in claim 12 wherein said fastening means are removable bolts and nuts.

14. An extruded light-weight blade support with a blade for a figure skate as claimed in claim 9 wherein said strip of carbon steel is chemically adhered to said light-weight alloy of said bottom edge.

15. An extruded light-weight blade support with a blade for a figure skate as claimed in claim 14 wherein said strip of carbon steel is one eighth of an inch wide.

16. An extruded light-weight blade support with a blade for a figure skate as claimed in claim 9 wherein said blade is laser cut.

* * * * *